US008794600B2

(12) United States Patent
Chou

(10) Patent No.: US 8,794,600 B2
(45) Date of Patent: Aug. 5, 2014

(54) BUBBLE GENERATING DEVICE

(76) Inventor: Wu-Chiao Chou, Taichung (TW)

( * ) Notice: Subject to any disclaimer, the term of this patent is extended or adjusted under 35 U.S.C. 154(b) by 629 days.

(21) Appl. No.: 13/153,666

(22) Filed: Jun. 6, 2011

(65) Prior Publication Data

US 2012/0306108 A1 Dec. 6, 2012

(51) Int. Cl.

| | |
|---|---|
| ***B01F 3/04*** | (2006.01) |
| ***B01F 13/00*** | (2006.01) |
| ***B05B 7/00*** | (2006.01) |
| ***B01F 5/06*** | (2006.01) |
| ***B01F 5/04*** | (2006.01) |
| *B05B 7/24* | (2006.01) |

(52) U.S. Cl.

CPC ..... *B01F 3/04446* (2013.01); *B01F 13/0027* (2013.01); *B05B 7/2443* (2013.01); *B05B 7/0018* (2013.01); *B01F 5/0693* (2013.01); *B01F 5/0415* (2013.01); *B01F 5/0496* (2013.01); *Y10S 261/26* (2013.01)

USPC ..... 261/28; 261/78.2; 261/113; 261/DIG. 26

(58) Field of Classification Search

CPC .. B01F 3/04446; B01F 5/0415; B01F 5/0496; B01F 5/0693; B01F 13/0027; B05B 7/0018; B05B 7/0037; B05B 7/2416; B05B 7/2443

USPC ..... 261/28, 64.1, 76, 78.2, 105, 113, 261/DIG. 26

See application file for complete search history.

(56) References Cited

U.S. PATENT DOCUMENTS

| | | | | | |
|---|---|---|---|---|---|
| 2,492,037 | A | * | 12/1949 | Freeman et al. | 261/116 |
| 2,715,045 | A | * | 8/1955 | Thompson | 239/343 |
| 3,388,868 | A | * | 6/1968 | Watson et al. | 239/427 |
| 4,219,159 | A | * | 8/1980 | Wesner | 239/343 |
| 4,925,109 | A | * | 5/1990 | Flanagan et al. | 239/429 |
| 5,054,688 | A | * | 10/1991 | Grindley | 239/407 |
| 5,275,763 | A | * | 1/1994 | Fukai | 261/78.2 |
| 5,364,031 | A | * | 11/1994 | Taniguchi et al. | 239/330 |
| 5,382,389 | A | * | 1/1995 | Goodine et al. | 261/18.1 |
| 5,404,957 | A | * | 4/1995 | McCormack | 169/70 |
| 5,789,457 | A | * | 8/1998 | Eiben et al. | 521/130 |
| 7,229,067 | B2 | * | 6/2007 | Dimarzo et al. | 261/79.2 |
| 8,231,111 | B2 | * | 7/2012 | Chang | 261/79.2 |

* cited by examiner

*Primary Examiner* — Charles Bushey

(74) *Attorney, Agent, or Firm* — Muncy, Geissler, Olds & Lowe, P.C.

(57) ABSTRACT

A bubble generating device includes a body having a front cover and a rear cover connected to the front cover. The front cover has a nozzle which has a passage defined therein. The rear cover has a space defined therein. A connection tube is connected to the rear cover and has a through hole so as to be connected with a spray gun. A bubble generating unit has a first net member and a second net member, both of which are located in the space. The space is defined into an expansion area, a pressure area and a bubble accumulating area by the first and second net members. The detergent is delivered into the expansion area and generates bubbles in the bubble accumulating area. The bubbles are accumulated into big lump of bubbles and sprayed by the air stream.

7 Claims, 6 Drawing Sheets

BUBBLE GENERATING DEVICE

FIELD OF THE INVENTION

The present invention relates to a bubble generating device, and more particularly, to a bubble generating device which generates bubbles by detergent and the bubbles are sprayed via a nozzle.

BACKGROUND OF THE INVENTION

A conventional pneumatic bubble generating device is generally connected with a high pressure spray gun and the detergent is transformed into mist which is sucked into the bubble generating device. The bubble generating device includes sponges or non-woven fabrics which include multiple orifices and the detergent passes through the sponges or non-woven fabrics to generate the bubbles which are then sprayed by high pressure and attached on the objects to be cleaned.

However, the generation of the bubbles is not satisfied because the orifices are arranged randomly and the broken bubbles and the mist leave significant detergent in the orifices, and the detergent flows between the orifices and form a bubble-like film with other detergent in other orifices. The film is blown into bubbles which are lighter than the air so that the bubbles are delivered to a far distance. Some detergent is sprayed by the high pressure air stream and forms tiny bubbles which have smaller surface which cannot be attached with other bubbles to form large bubbles. The small bubbles are easily vaporized and broken so that they cannot be attached on the objects to be cleaned.

The sponges or non-woven fabrics with multiple orifices tend to be deformed by the impact form the high pressure streams and the deformed sponges or non-woven fabrics make the orifices to be uneven which affect the flow of the air and the detergent. Besides, the sponges or non-woven fabrics are easily rotten and cannot be cleaned. The sponges or non-woven fabrics are gradually sheared into pieces which cannot generate sufficient bubbles.

The sponges or non-woven fabrics have limited time of life and it is inconvenient for the users to clean them regularly.

In order to prevent leakage, the sponges or non-woven fabrics are glued and different to disassemble from the body. Once the sponges or non-woven fabrics are disassembled from the body of the spray gun, leakage is almost not avoided.

The present invention intends to provide a bubble generating device which improves the shortcomings of the conventional devices.

SUMMARY OF THE INVENTION

The present invention relates to a bubble generating device and includes a body having a front cover and a rear cover connected to the front cover. The front cover has a nozzle which has a passage defined therein. The rear cover has a space defined therein. A connection tube is connected to the rear cover and has a through hole. The connection tube has threads so as to be connected with a spray gun. A bubble generating unit has a first net member and a second net member, both of which are located in the space. Each of the first and second net members has a guide plate located on a surface thereof so as to guide air stream to expand radially. The space is defined into an expansion area, a pressure area and a bubble area by the first and second net members.

Each of the first and second net members has a net located in a ring and the net is made of stainless steel which can be used for a longer period of time and is strong enough to prevent from being deformed. The stainless steel nets are easily cleaned and replaced.

The detergent in container is sucked by the pressure difference caused by the high pressure air stream and delivered into the expansion area. The detergent is spread to the first net member and forms thin films on the orifices of the first net member. The thin films are deformed bubbles by the air stream and pass through the first net member. Some of the films that do not yet become bubbles are moved to the pressure area between the first and second net members. The speed of the air stream is slow in the pressure area so that the particles of the detergent become larger particles and form bubbles on the first net member and are attached onto the second net member in the form of thin films. The air stream blows the thin films which are transferred into bubbles passing through the second net member. The bubbles are accumulated in the bubble accumulating area. The bubbles are efficiently built by limited detergent so that the detergent required is reduced which provides less impact to the environment. The bubbles are attached to the objects to be cleaned for longer period of time so that the effect of clean is increased. The light bubbles can be sent to a longer distance by the air stream.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
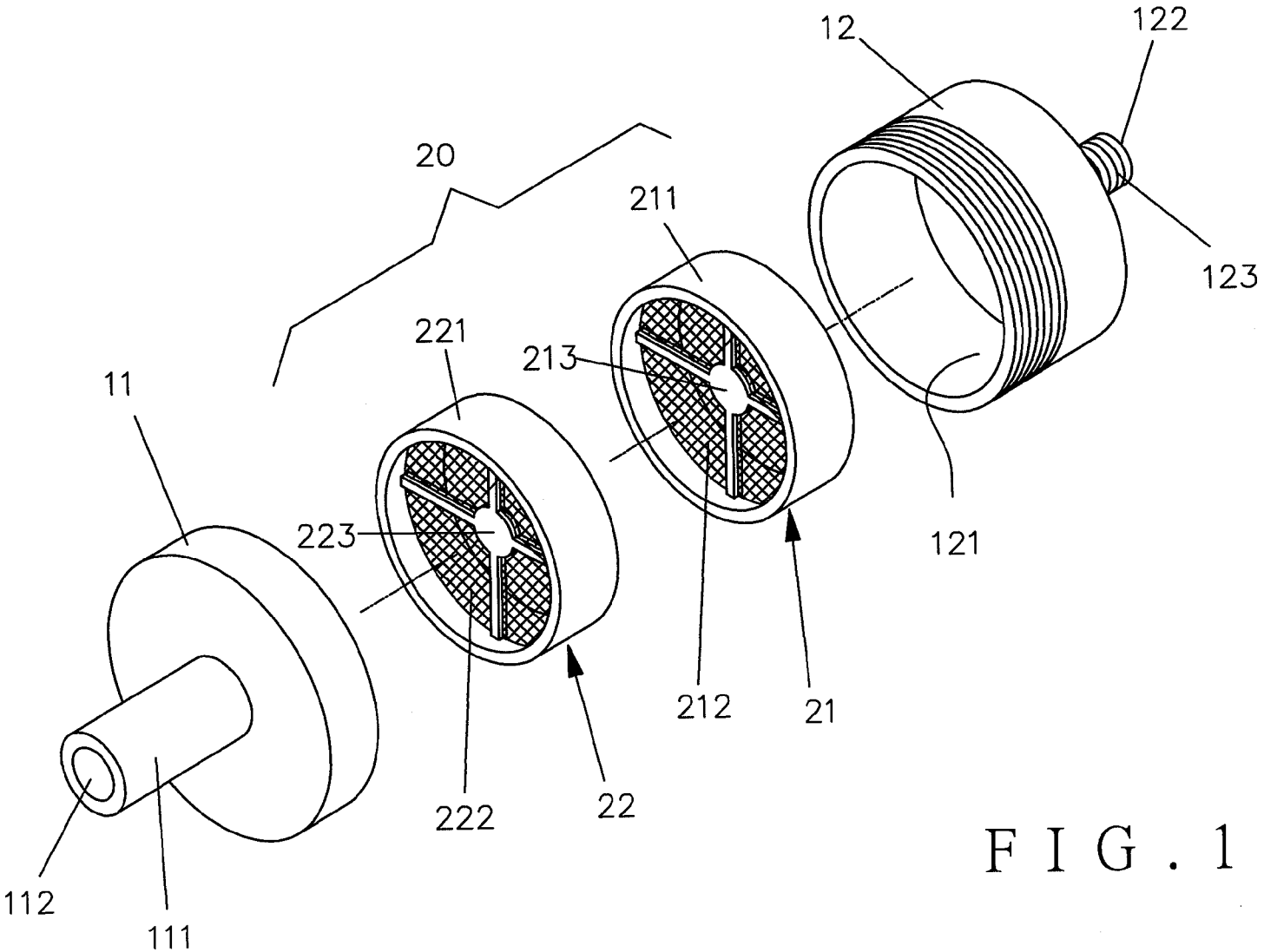
FIG. 1 is an exploded view to show the bubble generating device of the present invention.
Figure 2:
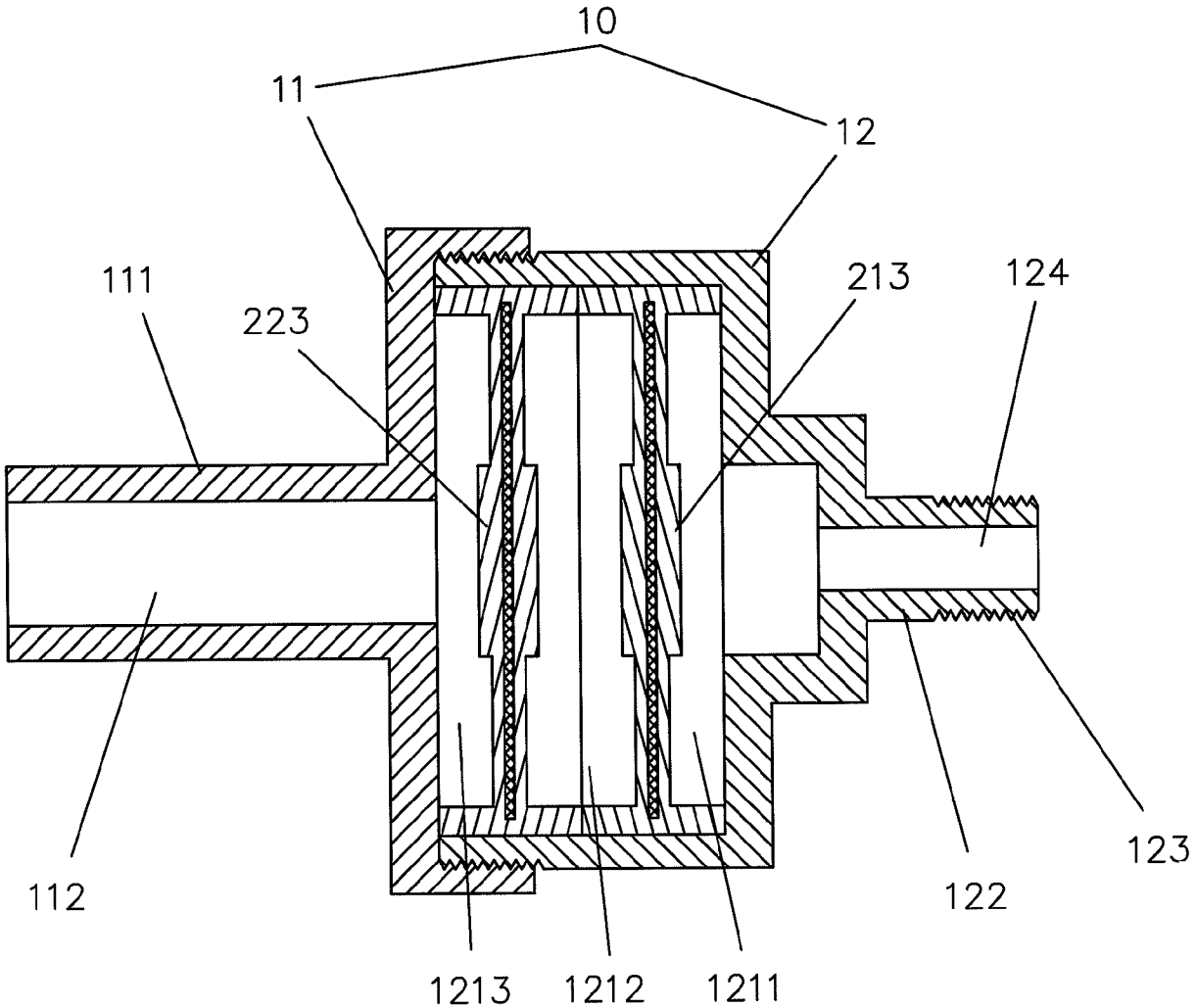
FIG. 2 is a cross sectional view of the bubble generating device of the present invention.

Referring to FIGS. 1 and 2, the bubble generating device of the present invention comprises a body 10 and a bubble generating unit 20 located in the body 10.

The body 10 has a front cover 11 and a rear cover 12 which is threadedly connected to the front cover 11. The front cover 11 has a nozzle 111 which has a passage 112 defined therein. The rear cover 12 has a space 121 defined therein. A connection tube 122 is connected to the rear cover 12 and has threads 123 so as to be connected with a pressure spray gun. The connection tube 122 has a through hole 124 defined therethrough.

The bubble generating unit 20 has a first net member 21 and a second net member 22. The first and second net members 21, 22 are located in the space 121. The space 121 in the rear cover 12 is defined into an expansion area 1211, a pressure area 1212 and a bubble accumulating area 1213 by the first and second net members 21, 22. Each of the first and second net members 21, 22 has a net 212, 222 located in a ring 211, 221, and each of the nets 222 is made of stainless steel which is strong and is corrosion resistant. Each of the first and second net members 21, 22 has a guide plate 213/223 located on a surface thereof, and the guide plate 213/223 is located corresponding to the through hole 124 corresponding thereto.

Figure 3:
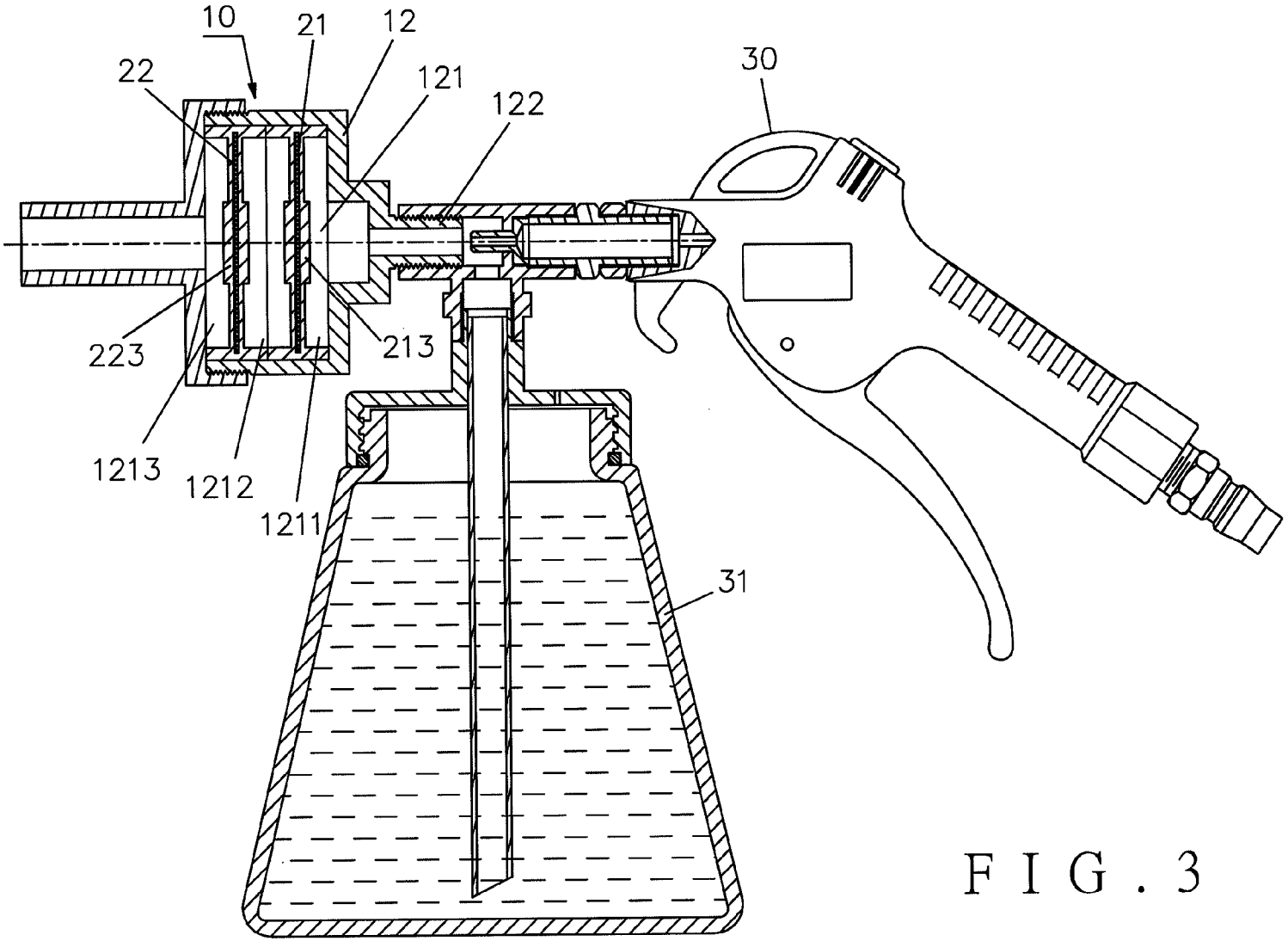
FIG. 3 shows that the bubble generating device of the present invention is connected with a pressure spray gun.
Figure 4:
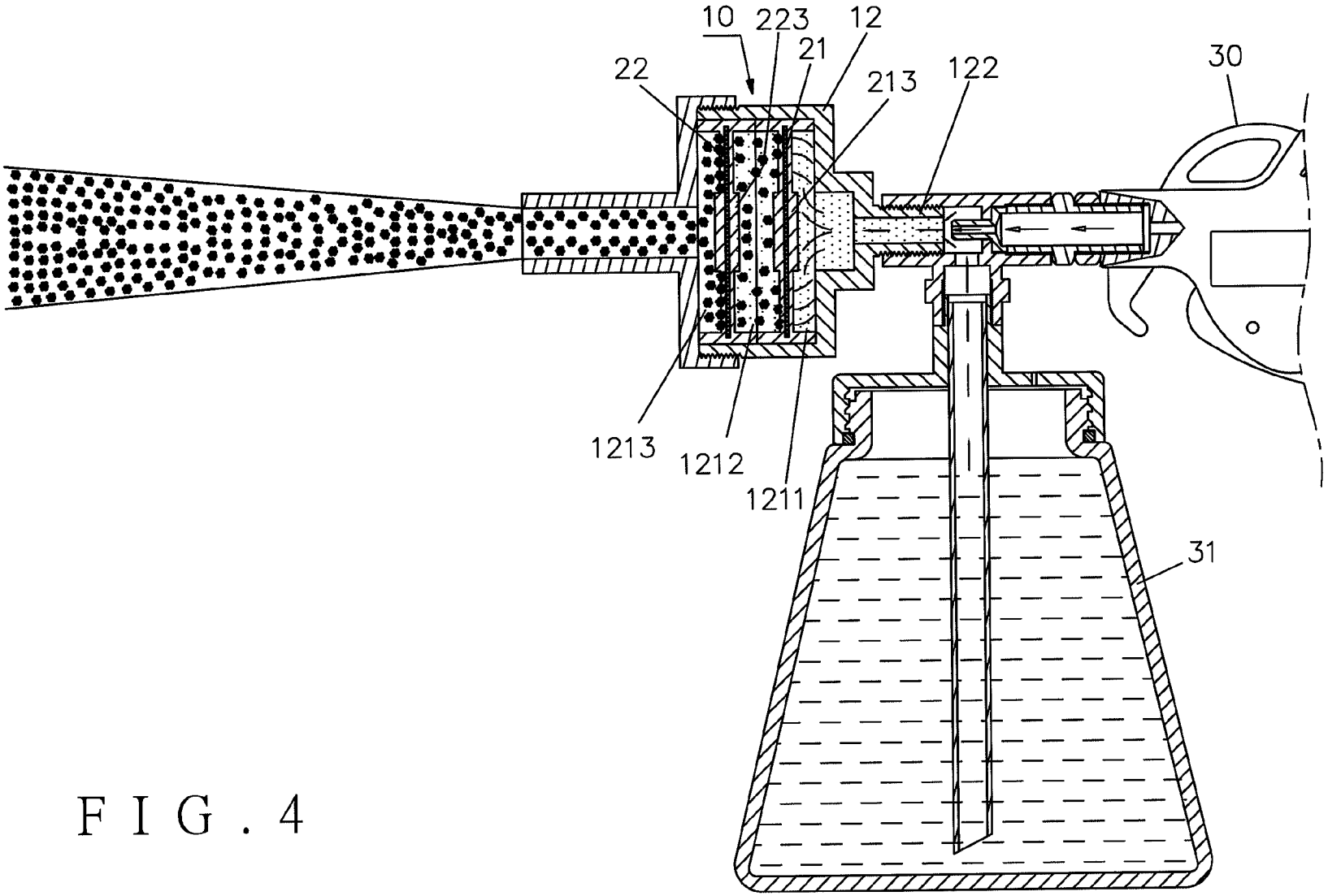
FIG. 4 shows that the bubbles are sprayed from the bubble generating device of the present invention.

As shown in FIGS. 3 and 4, the connection tube 122 on the rear cover 12 is connected with a pressure spray gun 30. The detergent in the container 31 is sucked by the pressure difference caused by the high pressure air stream and delivered into the rear cover 12 in the form of mist. The detergent is then guided by the guide plate 213 of the first net member 21 to spread radially and enters into the expansion area 1211 in the space 121 and the first net member 21. The combination of the pressurized air and the detergent is restricted from passing only through the center of the first net member 21 so as to generate bubbles. The guide plates 213, 223 guide the air stream to flow radially and outward and to stir the air and the detergent.

The orifices of the first net member 21 are evenly located so that when the detergent passes through the orifices, the detergent will be attached on the first net member 21 and forms thin films on the orifices. The detergent that does not form into bubbles will enter into the pressure area 1212 of the first net member 21. The speed of the air stream is slow in the pressure area 1212 so that the particles of the detergent become larger particles and form bubbles on the first net member 21 and are attached onto the second net member 22 in the form of thin films. The air stream blows the thin films which are transferred into bubbles passing through the second net member 22. The bubbles are accumulated in the bubble accumulating area 1213. The bubbles are efficiently built by limited detergent so that the detergent required is reduced which provides less impact to the environment. The bubbles are attached to the objects to be cleaned for a longer period of time so that the effect of clean is increased. The light bubbles can be sent to a longer distance by the air stream. The applicant tested the distance that the bubbles can be sent is about 2 to 2.5 meters.

Figure 5:
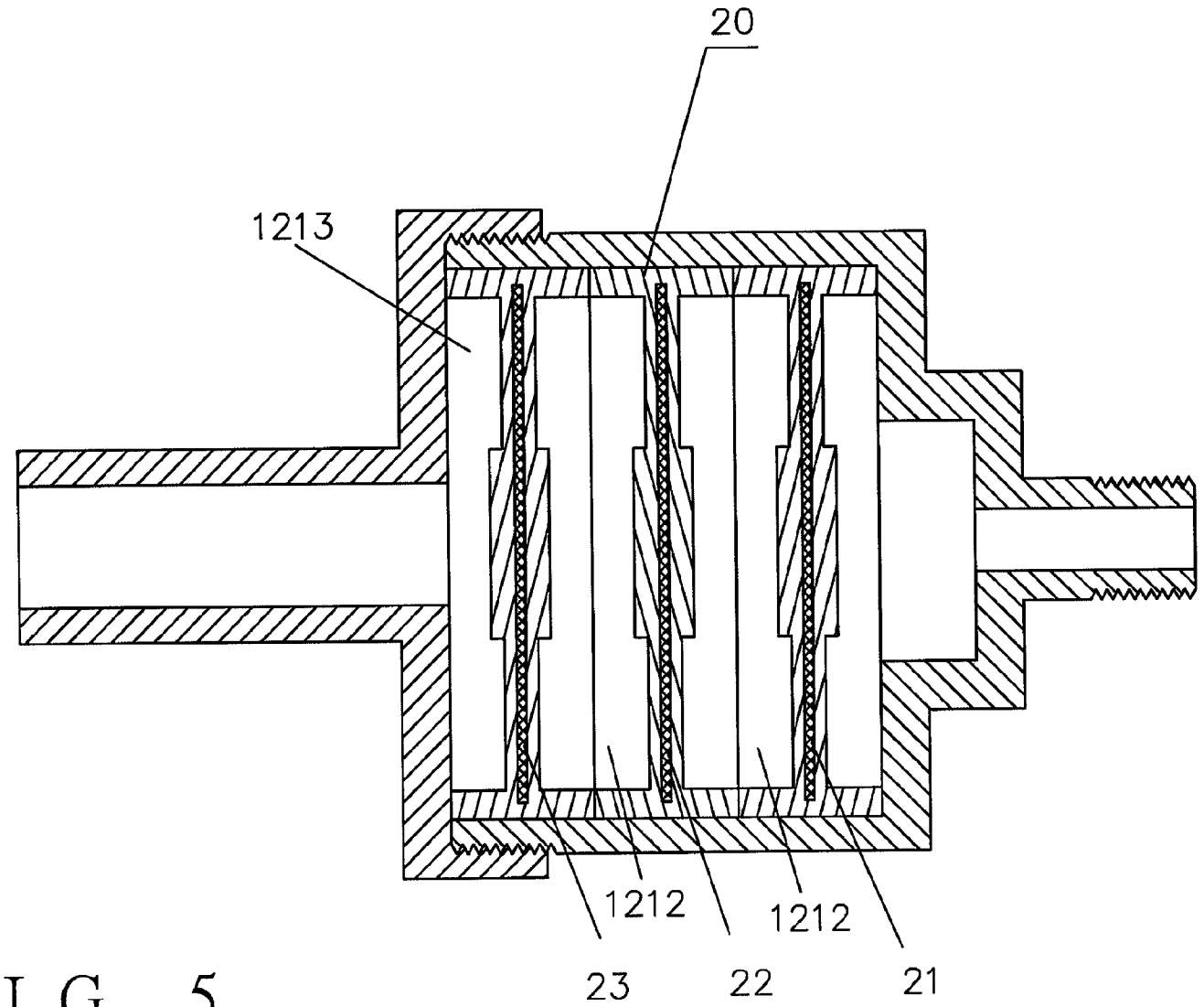
FIG. 5 shows that the bubble generating device of the present invention has three nets.

As shown in FIG. 5, the bubble generating unit 20 comprises three net members which are the first net member 21, the second net member 22 and the third net member 23 or even the fourth net member. By the first and second net members 21, 22, the pressure in the pressure area 1212 is increased which slows down the speed of the air stream. The particles of the detergent become larger particles which are attached onto the third net member 23 and form thin films. The air stream with low speed blows the thin films through the third net member 23 to form bubbles which are accumulated in the bubble accumulating area 1213 and sent by air stream.

Figure 6:
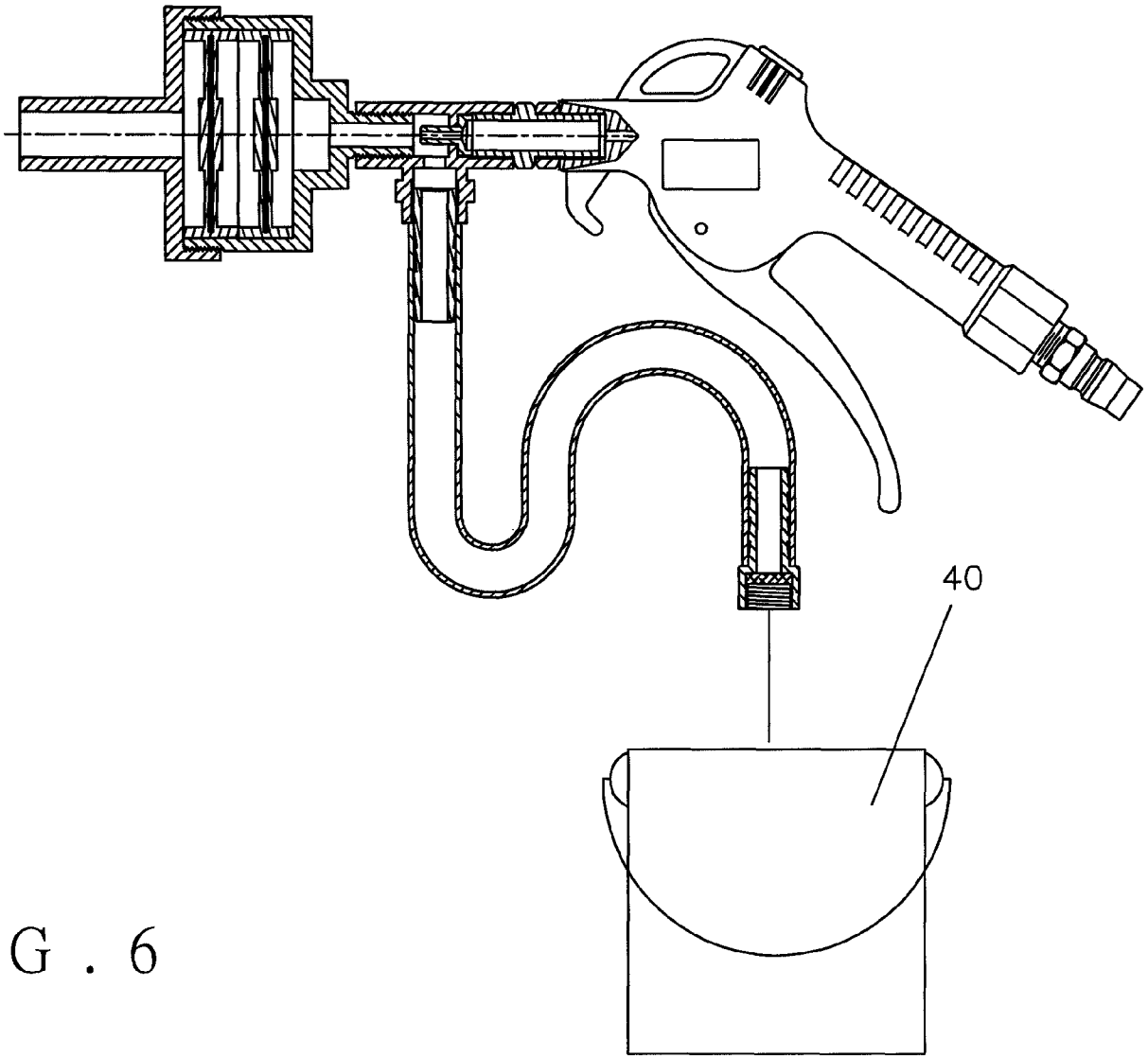
FIG. 6 shows that the bubble generating device of the present invention is connected with a tank.

As shown in FIG. 6, the present invention is also connected with a commercial-use pressure spray gun with a large tank 40 for receiving more detergent.

The bubble generating device of the present invention has a simplified structure and the first and second net members are able to generate lumps of bubbles. The number of the net members can be adjusted according to practical needs. The bubbles are generated efficiently and the net members are easily cleaned and replaced. There will be no detergent left inside the device to affect the generation of the bubbles. The bubbles are formed in the form of lumps which are lighter than the air so that the bubbles can be sent to a far distance to provide a larger area of cleaning. The bubbles are formed by limited amount of detergent so that the demand of the detergent is minimized and the impact to the environment is reduced. The bubbles are generated efficiently and concentrated so that the cleaning efficiency is increased. The nets are made of stainless steel which is strong and corrosion resistant. The nets do not need to replace or clean often.

While we have shown and described the embodiment in accordance with the present invention, it should be clear to those skilled in the art that further embodiments may be made without departing from the scope of the present invention.

What is claimed is:

1. A bubble generating device comprising:

a body having a front cover and a rear cover which is connected to the front cover, the front cover having a nozzle which has a passage defined therein, the rear cover having a space defined therein, a connection tube connected to the rear cover and having threads, the connection tube having a through hole defined therethrough; and a bubble generating unit having a first net member and a second net member, the first and second net members being located in the space, wherein each of the first and second net members has a cross-shaped guide plate located on a surface thereof, and wherein the cross-shaped guide plates of the first and second net members each has a circular central portion having a diameter greater than or equal to a diameter of the through hole and corresponding in position to the through hole.

2. The device as claimed in claim 1, further comprises a third net member.

3. The device as claimed in claim 2, wherein the space in the rear cover is defined into an expansion area, a pressure area and a bubble accumulating area by the first and second net members.

4. The device as claimed in claim 2, wherein each of the first, second and third net members has a net located in a ring.

5. The device as claimed in claim 4, wherein the net is made of stainless steel.

6. The device as claimed in claim 1, wherein each of the first and second net members has a net stretched by a ring, and the cross-shaped guide plates of the first and second net members each has four ends adjacent to the ring of a corresponding one of the first and second net members.

7. The device as claimed in claim 1, wherein the first and second net members are generally plane and parallel to each other.

* * * * *